US008407831B2

(12) United States Patent
White et al.

(10) Patent No.: US 8,407,831 B2
(45) Date of Patent: Apr. 2, 2013

(54) PATIENT POSITIONING APPARATUS

(75) Inventors: Elizabeth White, American Fork, UT (US); Andrew Michael Rosenvell, Provo, UT (US); Stefano Demartin, Provo, UT (US); Joshua Robert Oldham, Provo, UT (US); Jason Thomas Silvenis, Provo, UT (US); Gerrit Tennyson Larsen, Provo, UT (US); Bret David Nicholson, Provo, UT (US)

(73) Assignee: Ergonurse, Inc., Frisco, TX (US)

( * ) Notice: Subject to any disclaimer, the term of this patent is extended or adjusted under 35 U.S.C. 154(b) by 0 days.

(21) Appl. No.: 11/403,112

(22) Filed: Apr. 12, 2006

(65) Prior Publication Data

US 2007/0240260 A1 Oct. 18, 2007

(51) Int. Cl.
*A61G 7/10* (2006.01)

(52) U.S. Cl. ..... 5/87.1; 5/83.1; 5/89.1; 212/901

(58) Field of Classification Search ..... 5/83.1, 5/87.1, 85.1, 81.1 R, 86.1, 88.1, 89.1; 212/901
See application file for complete search history.

(56) References Cited

U.S. PATENT DOCUMENTS

| | | | | |
|---|---|---|---|---|
| 1,098,477 | A | | 6/1914 | Cashman |
| 1,528,835 | A | | 9/1922 | McCullough |
| 2,683,882 | A | * | 7/1954 | Smith ..... 5/86.1 |
| 2,688,410 | A | | 9/1954 | Nelson |
| 2,792,945 | A | | 5/1957 | Brenny |
| 4,747,170 | A | | 5/1988 | Knouse |
| 4,887,325 | A | | 12/1989 | Tesch |
| 5,077,844 | A | | 1/1992 | Twitchell |
| 5,161,267 | A | | 11/1992 | Smith |
| 5,181,289 | A | | 1/1993 | Kassai |
| 5,210,887 | A | | 5/1993 | Kershaw |
| 5,274,862 | A | | 1/1994 | Palmer, Jr. |
| 5,333,334 | A | | 8/1994 | Kassai |
| 5,487,195 | A | | 1/1996 | Ray |
| 5,499,408 | A | | 3/1996 | Nix |
| 5,524,304 | A | | 6/1996 | Shutes |
| 5,539,941 | A | * | 7/1996 | Fuller ..... 5/85.1 |
| 5,544,371 | A | | 8/1996 | Fuller |
| 5,673,443 | A | | 10/1997 | Marmor |
| 5,758,371 | A | * | 6/1998 | VanDyke et al. ..... 5/86.1 |
| 5,890,238 | A | | 4/1999 | Votel |
| 5,901,388 | A | | 5/1999 | Cowan |
| 5,937,456 | A | | 8/1999 | Norris |

(Continued)

OTHER PUBLICATIONS http://www.hoyerlift.com/

*Primary Examiner* — Michael Trettel
(74) *Attorney, Agent, or Firm* — Kirton McConkie; F. Chad Copier

(57) ABSTRACT

A patient positioning apparatus comprising a base, a support column, at least one positioning arm on the support column capable of being positioned over a bed and having a buckle and strap capable of securing to a patient support with a receiving buckle so that a patient can be partially or totally suspended when an adjustable bed is lowered. The apparatus further comprising a telescoping support column and horizontal support for holding a first and second positioning arm. The positioning arms further comprising locking pivots for extending and retracting. Patient repositioning is effectuated by positioning the arms over a patient, extending straps with buckle inserts into receiving buckles on a fabric gripper secured to bed linens. A patient positioning apparatus can further be mounted to either a ceiling or a wall or can comprise a swiveling support column.

11 Claims, 18 Drawing Sheets

U.S. PATENT DOCUMENTS

| | | | | |
|---|---|---|---|---|
| 6,026,523 | A | 2/2000 | Simon | |
| 6,035,465 | A | 3/2000 | Rogozinski | |
| 6,047,418 | A | 4/2000 | Seide | |
| 6,049,923 | A | 4/2000 | Ochiai | |
| 6,282,734 | B1 | 9/2001 | Holberg | |
| 6,321,398 | B1 | 11/2001 | Wang | |
| 6,378,148 | B1 | 4/2002 | Votel | |
| 6,496,991 | B1 | 12/2002 | Votel | |
| 6,637,610 | B1 | 10/2003 | Cheeseboro | |
| 6,662,388 | B2 | 12/2003 | Friel | |
| 6,668,396 | B2 | 12/2003 | Wei | |
| 6,694,545 | B1 | 2/2004 | Renton | |
| 6,728,979 | B1 | 5/2004 | Robert | |
| 6,857,144 | B1 | 2/2005 | Huang | |
| 2002/0038477 | A1* | 4/2002 | Mowery | 5/86.1 |
| 2002/0083522 | A1 | 7/2002 | Sverdlik | |
| 2003/0110559 | A1 | 6/2003 | Weigand | |
| 2004/0148699 | A1 | 8/2004 | Fernie | |
| 2004/0221388 | A1 | 11/2004 | Votel | |
| 2005/0039256 | A1 | 2/2005 | Price | |
| 2005/0044629 | A1 | 3/2005 | Rouse | |
| 2006/0137091 | A1* | 6/2006 | Gramkow et al. | 5/86.1 |

* cited by examiner

PATIENT POSITIONING APPARATUS

BACKGROUND OF THE INVENTION

1. Field of the Invention

The present invention relates to an apparatus for assisting a caregiver when transferring, rotating, or otherwise repositioning a bedridden person. More particularly, the present invention comprises a single collapsible unit possessing arms for repositioning a bedridden patient by utilizing existing lift technology on a hospital bed to create suspension or patient movement.

2. Description of Related Prior Art

Immobility of a patient contributes greatly to the deterioration of patient health. Immobile patients are prone to bedsores and pneumonia. A bed sore can take months or years to heal depending on the severity and location of the sore. Pneumonia occurs in immobile patients because secretions pool in the lungs fostering bacterial growth. Generally side-to-side turns of such patients, approximately every two hours, can prevent many occurrences of bedsores and pneumonia. Additionally, side-to-side turns are necessary to accomplish examinations of the patient. However, turns of this nature are generally the responsibility of hospital nurses, orderlies, or other staff in similar types of facilities.

Additionally, patients require the head of the bed to be raised to facilitate breathing and increase comfort. As a result of this incline, patients tend to slide toward the foot of the bed, impeding a patient's normal breathing and digestive functions and resulting in patient discomfort.

When a patient is obese or larger than the staff member, the force required to properly reposition the patient is considerable. Consequently, multiple staff members are required to reposition the patient manually. Moreover, if additional staff members are unavailable, the lone staff member is susceptible to injuries while attempting to transfer or reposition the patient without either mechanical assistance or, additional staff labor.

Back injury is a common work injury of nurses and hospital staff generally as a result of moving overweight, obese or patients who are significantly larger than the staff member. The act of turning a patient from side to side precludes proper body mechanics for lifting. In addition, obesity in the United States is increasing in marked amounts. Patient weight increases will only exacerbate the rate of back injuries among nurses, and increase the number of workers compensation claims filed as a result of such injuries as well as reduce the number of able body hospital staff. Consequently, assistance is necessarily required to accomplish necessary patient movement as well as protect hospital staff members against injury proximately resulting from patient repositioning, turning and transference.

Moreover, the task of patient repositioning is labor intensive and time consuming. Generally, patient movement requires at least two staff members. Generally nurses are female and significantly smaller in stature and weight then the patients they are assigned to care for. Furthermore, hospitals and skilled nursing facilities are homes to patients weighing in excess of 250 pounds. Consequently, at least three staff members are sometimes required to reposition a patient of this size. With the increase of nursing and staffing shortages, it is frequently impossible to gather enough staff members to move a large or oversized patient. Thus, either patient care suffers or the risk of injury to staff members is greatly increased.

Another problem is money. Devices that incorporate machines, motors, and other complicated machinations to effectuate lift and other movement cost much more money than those that don't as well as incur more potential for civil liability should one of those machinations fail. Further, existing devices do not have a simple and effective means of gripping fabric, draw sheets, or standard hospital bed linens on which a patient is lying. Typically, devices such as that found in U.S. Pat. No. 5,890,238 to Votel are meant for patient transfer only and because of the gripping design are not easy for a caregiver to attach to linens.

Therefore a need exists for a functional, yet simple to operate, patient repositioning apparatus. Such an apparatus must be operational by one staff member without compromising patient safety and staff member safety; easy to install and operate as well as not consume scarce space in hospital or skilled nursing facility; must not compromise patient safety when effectuating the tasks of patient repositioning; can be used by a single caregiver to reposition a patient; is capable of easy attachment to linens for suspension of a person; and does not require expensive internal machinations to accomplish patient lift but uses existing lift technology on beds to accomplish suspension or movement of a patient.

SUMMARY OF THE INVENTION

Accordingly, one object of the present invention is to provide an apparatus capable of being operated by one person to reposition a patient longitudinally in a bed, reposition a patient laterally within the bed, turning a patient on their side, or lifting a patient.

A second object of the invention is an apparatus that easily integrates with standard hospital beds during usage.

A third object of the invention is to provide an apparatus which repositions a patient without injuring either the patient or staff member.

A fourth object of the invention is to provide an apparatus that does not consume precious space in skilled care facilities, hospitals or patient homes, and is easily stored when not in service.

A fifth object of the invention is to provide an apparatus which is inexpensive to produce and thus easily purchased by medical care facilities and family members faced with caring for immobile loved-ones in their home.

A sixth object of the invention is to reposition a patient to facilitate normal respiratory and digestive function.

An eighth object of the invention is to reduce patient feelings of patient isolation because the apparatus is less obtrusive than the prior art.

A ninth object of the present invention is to provide a repositioning apparatus that is able to use the lift of a hospital bed to reposition a patient through suspension when the bed is lowered.

A tenth object of the present invention is to provide a simple attachment device that will easily secure to linens.

DETAILED DESCRIPTION OF THE DRAWINGS AND PREFERRED EMBODIMENTS

Figure 1:
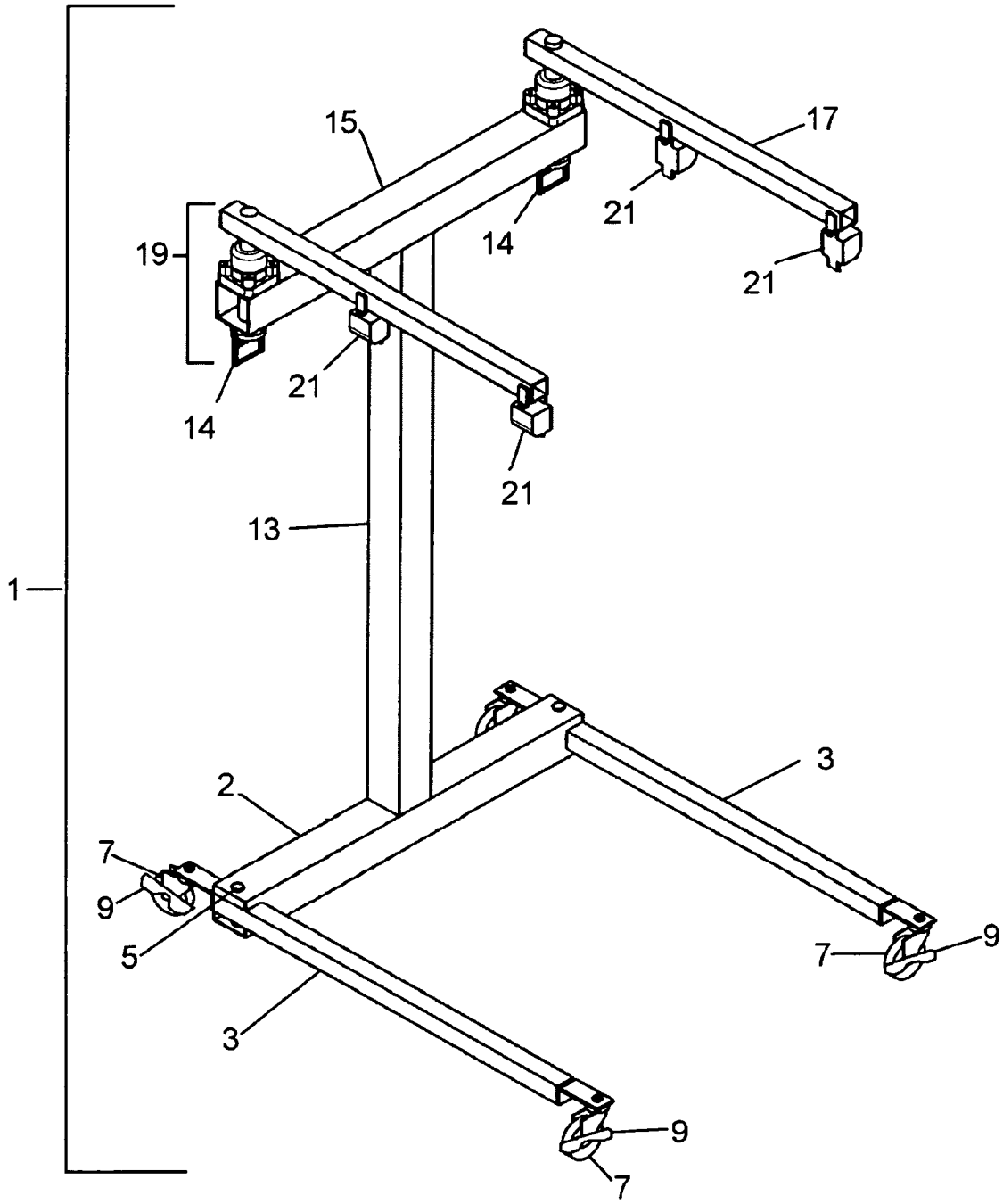
FIG. 1 is an elevated perspective view of a patient positioning apparatus with positioning arms in an extended position.

A complete understanding of this invention can be gained through reference to the drawings in conjunction with a thorough review of the disclosure herein. To facilitate this understanding, a table of commonly used reference numerals is provided.

| | |
|---|---|
| 1 | positioning apparatus |
| 2 | base support |
| 3 | leg |
| 4 | pivot shaft |
| 5 | base rivets |
| 6 | flange bearing |
| 7 | wheels |
| 8 | bearing extension plate |
| 9 | wheel locks |
| 10 | hole stiffener |
| 11 | sleeve |
| 12 | top washer |
| 13 | support column |
| 14 | washer handle |
| 15 | horizontal support |
| 16 | belt support tabs |
| 17 | positioning arm |
| 18 | bottom washer |
| 19 | arm pivot assembly |
| 20 | spacer |
| 21 | retractable belt assembly |
| 23 | straps |
| 24 | buckle inserts |
| 25 | bed |

-continued

| | |
|---|---|
| 26 | person |
| 27 | support sheet pocket |
| 29 | receiving buckle |
| 33 | support sheet |
| 31 | clamps |
| 36 | wall mounted device |
| 37 | wall mount bracket |
| 38 | wall board |
| 39 | wall stud |
| 40 | ceiling mounted device |
| 41 | bracket bolt |
| 42 | overhead positioning arm support |
| 45 | hook |
| 46 | support sheet fabric |
| 47 | rod |
| 49 | hole in support sheet |
| 111 | top bar |
| 113 | bottom bar |
| 114 | hinge |
| 115 | serrated teeth |
| 117 | clamp support |
| 119 | clamp handle |
| 121 | wedge |
| 125 | pivot pin |

Figure 3:
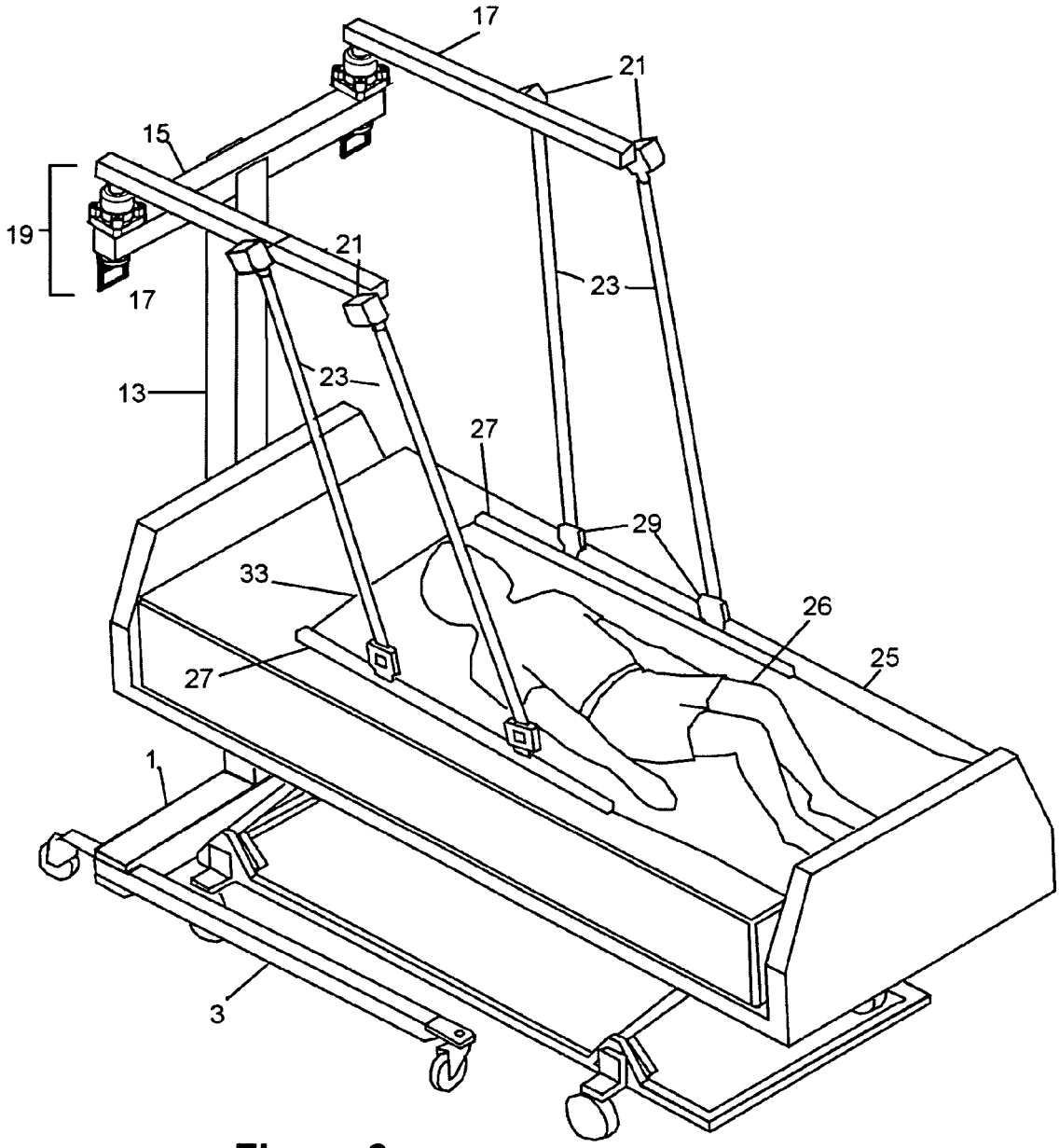
FIG. 3 is an elevated perspective view of a patient positioning apparatus positioned over a standard hospital bed with adjustable straps secured to a support sheet.
Figure 4:
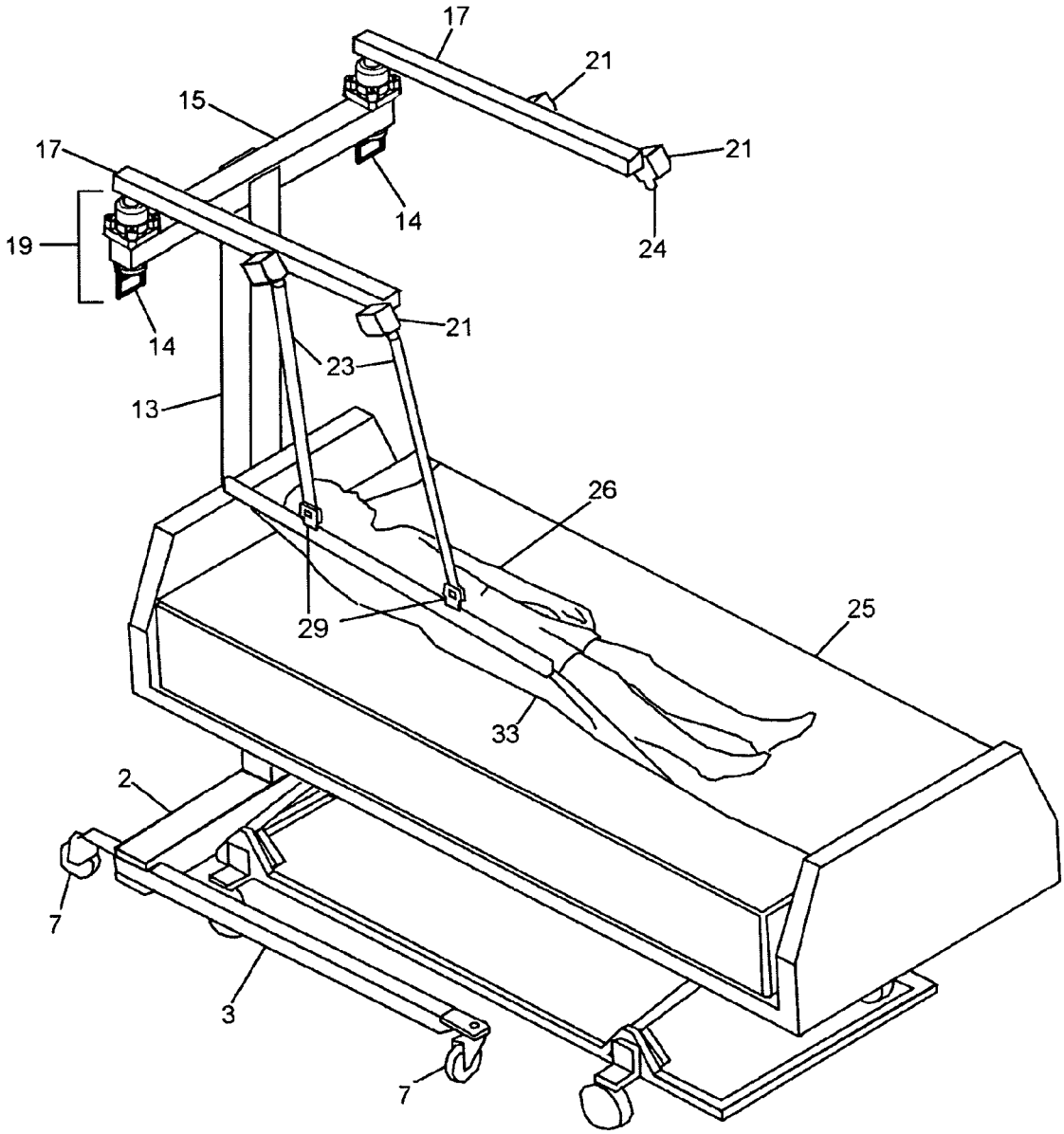
FIG. 4 is an elevated perspective view of a patient positioning apparatus positioned over a standard hospital bed with two adjustable straps secured to a support sheet and moving a person lying on the support sheet a quarter turn.
Figure 5:
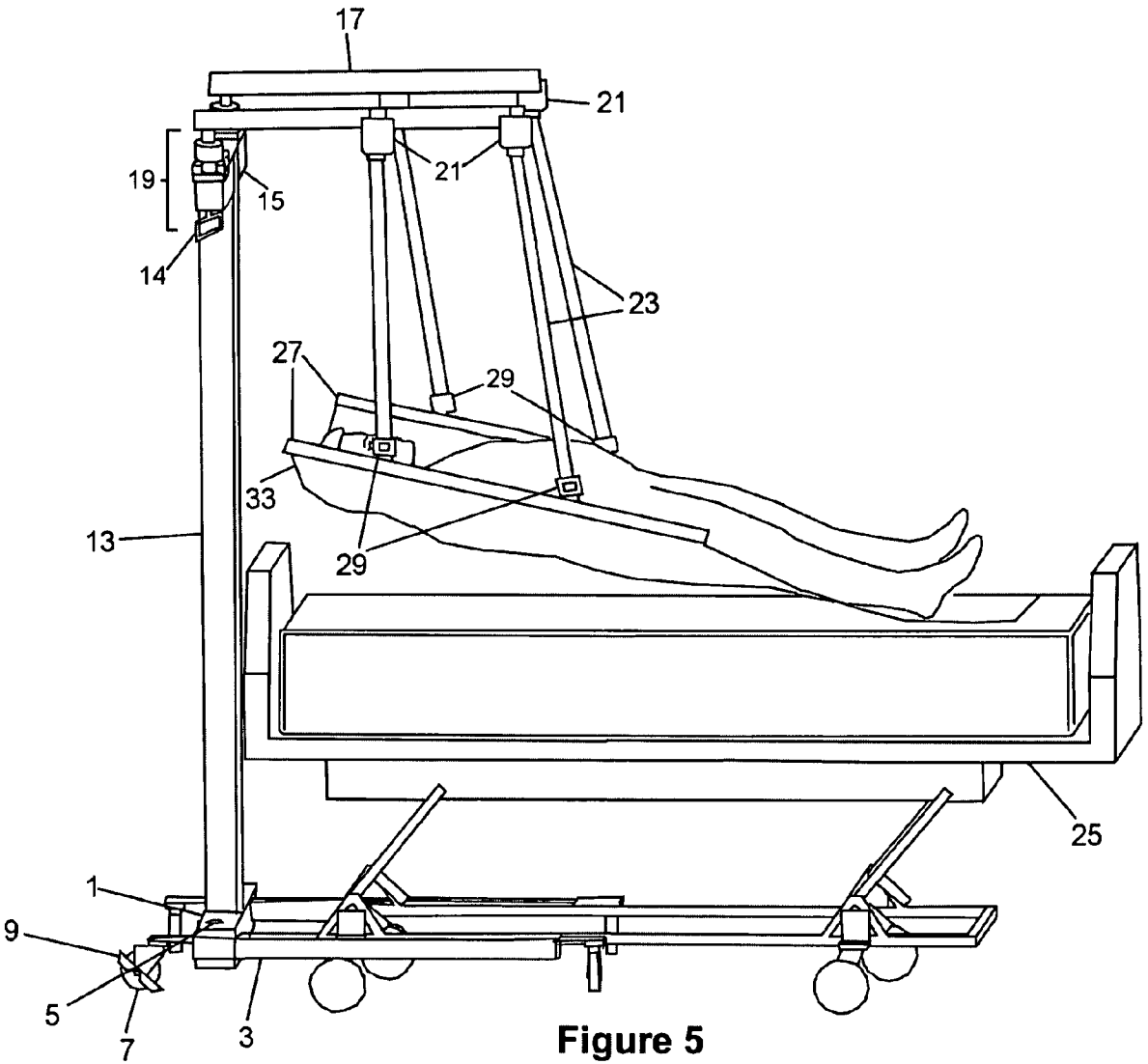
FIG. 5 is a side view of a patient positioning apparatus positioned over a standard hospital bed with adjustable straps secured to a support sheet and suspending a person lying on the support sheet.

FIG. 1 is illustrative of a preferred embodiment for repositioning a person in a standard hospital bed. As used in this patent, suspended or suspend would also include partially suspended or partially suspend where the bed or some other member also assists in supporting the patient. In this embodiment a positioning apparatus 1 is composed of a moveable base with wheels 7; a vertical support column 13; and having one or more positioning arms 17 on the top of the device 1 containing straps 23 and retractable belts 21 that extend downward and secure to a patient support sheet 33. (Shown in FIGS. 3 & 4) As shown in FIGS. 3 and 4 a patient on a bed can be repositioned by using the vertical movement of a standard hospital bed. (e.g., electrical, crank actuated, other mechanical motion, and etc) A bed 25 is raised upward towards the positioning arms 17 thereby giving slack to gripping straps 23 with retractable belt assembly 21 on the arms 17. Once there is slack in the straps 23 a buckle 24 on the ends of the straps can be inserted and locked into a buckle latch 29 on a patient support sheet 33. Once the buckles 24 are locked the bed 25 can be lowered and therefore a person is lifted by being suspended when the bed 25 is lowered thereby creating a sling.

An exemplary embodiment of a base portion incorporates one or more legs 3 capable of extending in opposite directions from either the anterior or posterior of the apparatus. It is a preferred embodiment that these legs 3 telescope, as in FIGS. 1 and 2, thereby allowing them to extend under a bed or retract when the apparatus is not in use thus, minimizing the space necessary to store the apparatus and to account for size differences in beds. Available means for forming a base with legs, wheels, swivels, and their various embodiments including locking and clamping mechanisms are described in related U.S. patent application Ser. No. 11/170,605 "Patient Mobility Apparatus" to White disclosed above. However, in an alternate embodiment, the base can be folded, or otherwise extended, collapsed, or legs locked for easy maneuverability and for providing sufficient stability.

Figure 2:
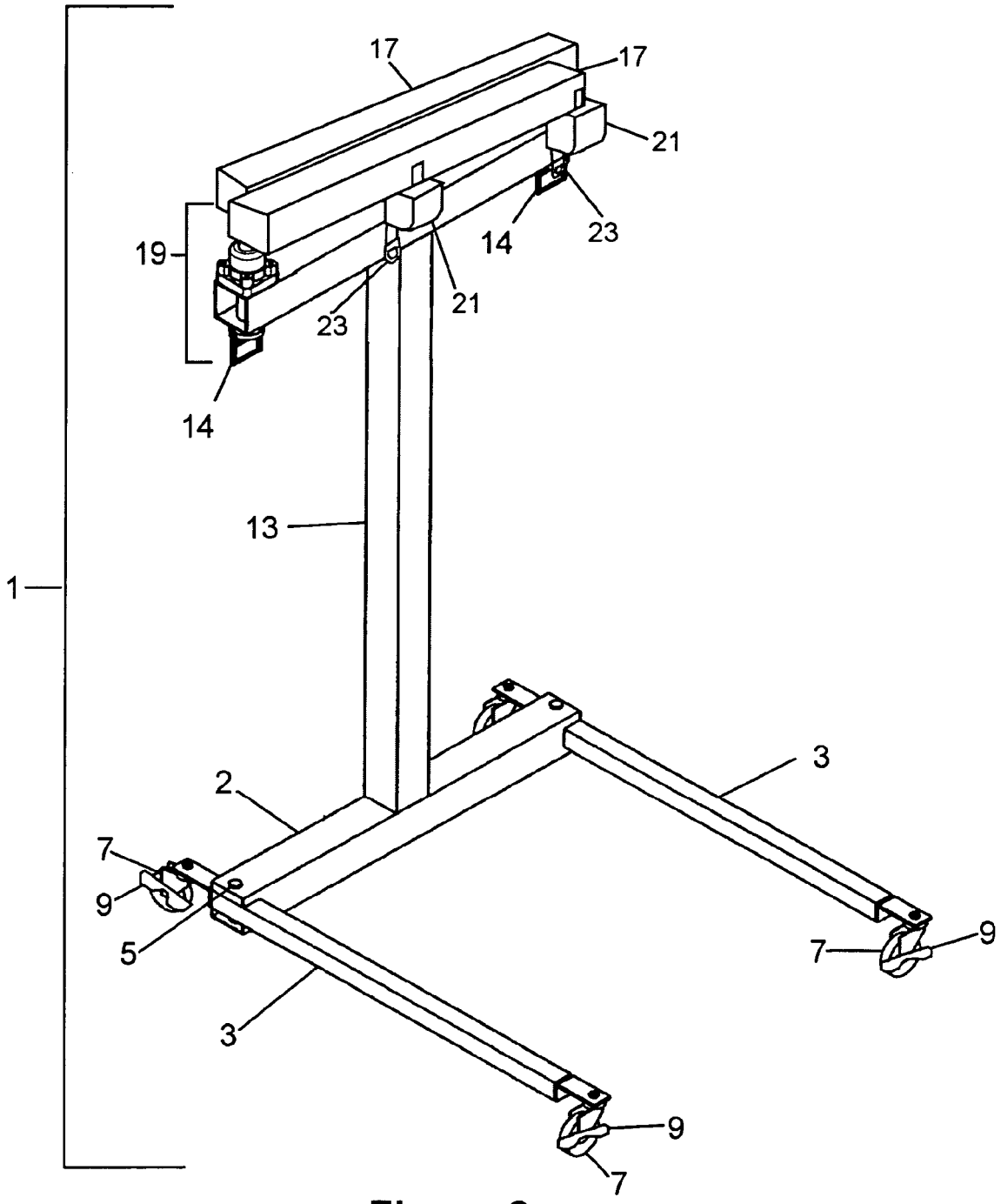
FIG. 2 is an elevated perspective view of a patient positioning apparatus with positioning arms in a retracted position.

FIGS. 1 and 2 also show a support column 13 that coupled to a base using known means. In a preferred embodiment, a support column 13 is fixed and is capable of supporting a repositioning structure comprised of a horizontal support 15 having one or more positioning arms 17. The repositioning structure is typically fixed using known means such as common welding techniques or being inserted and fastened to a groove in the support column 13 as is shown in FIGS. 1 and 2 to the upper portion of the support column 13. However, the repositioning structure can also be fixed to any place on the support column 13 so long as it is capable of being positioned over a bedridden person for repositioning.

The support column 13 of the preferred embodiment is constructed of powder-coated steel and is 4 inches square which has been proven to withstand the weight of a person 26—even those of substantial weight—suspended by arms 17.

In an alternate exemplary embodiment, (not shown) an outer column of the support column can swivel around an inner column with apertures. The outer column support, also having apertures, is capable of aligning with those of the inner column by inserting the outer column over the inner column. In this way the swivel can be locked by inserting a locking pin through each of the inner and outer column support apertures. Other known means for creating a swiveling column will be immediately recognized by those skilled in the art.

Most hospital beds are of a standard height. Because of the uniform height of beds, a fixed height support column 13 will prove to be an effective embodiment of the present invention. However, because some beds will vary in height and will vary in the levels of vertical movement it is sometimes preferable to have an embodiment of the present invention that can also accommodate vertical movement.

To effectuate vertical movement for the present invention to account for the differences in bed sizes, a crank assembly or an, hydraulic assembly described in related U.S. patent application Ser. No. 11/170,605 "Patient Mobility Apparatus" to White disclosed above may be incorporated into the present invention.

The repositioning structure atop the support column 13 is used for repositioning a patient 26 in a standard hospital bed 25. The position of the repositioning structure and its associated structures such as its arms 17 relative to the hospital bed 25 and the motor incorporated in to the hospital bed 25 is used as the means for repositioning a patient 26. Standard hospital beds typically come with an electric motor or other adjustable beds used to raise, lower, or otherwise place the bed 25 in various positions. Taking advantage of this standard lifting technology relative to the present invention allows for one caregiver to easily reposition a patient 26 using the various embodiments of the present invention.

FIGS. 3 and 4 illustrate repositioning movement using a preferred embodiment of the present invention. In FIG. 3 a person 26 is laid flat on a patient support sheet 33 that has pockets 27 capable of receiving a rod 47 making them rigid and also having receiving buckles 29 for receiving straps 23 with buckle inserts 24. A caregiver then positions the bed to an appropriate distance below the arms 17 such that the straps 23 are slack and the buckle inserts 24 can be inserted into the receiving buckles 29. Once the buckle inserts 24 are inserted into the receiving buckles 29 a caregiver then can either take out the slack in the straps 23 through adjustment of the straps 23 through automatic adjustment using known automatic retraction in the retractable belt assembly 21 or through manual adjustments methods. Any remaining slack, if any, can be taken out by lowering the bed and, once completely taken out, the patient 26 will be suspended on the support sheets 33. Once the patient 26 is suspended a caregiver can change bed sheets or perform other various tasks related to caring for a patient.

Retractable belt assemblies 21 can be coupled to the positioning arms 17 using support tabs 16 (See, FIG. 9) whereby a rivet (not shown) can be inserted through the tab and through a positioning arm 17. Equivalent methods in the art will be immediately recognizable for securing similar assemblies to metal structures such as those disclosed.

For example, FIG. 4 demonstrates how one embodiment of the present invention can be used to turn a patient a quarter turn by only inserting the buckle inserts 24 into the receiving buckles 29 on one side of a patient support sheet 33. In this way, once the bed is lowered so that slack is taken out of the straps 23, a patient can be partially turned from side to side.

To change patients' bed linens, a bottom support sheet 33 is placed underneath the bed linens. A bed 25 is then raised enough to allow for the insertion of the buckle inserts 24 into receiving buckles 29 onto one side of a support sheet 33. The bed linens are then loosened onto one side of the bed 25. By then lowering the bed 25, the person will roll to one side of the bed 25. The bed 25 is then raised and the buckle inserts 24 are removed from the receiving buckles 29 and a support sheet 33 is spread back onto the bed mattress. Once the dirty bed linens are rolled next to the patient 26 the clean linen is spread on one side of the mattress and the other half is rolled up next to the patient 26. On the other side of the bed 25, loosen the dirty linen and attach the buckle inserts 24 into the receiving buckles 29 on that side of the support sheet 33. The bed 25 is then lowered whereby the patient 26 rolls onto the clean linen. The bed is then raised and the buckle inserts are removed from the support sheet 33. Therefore, the dirty linen may be removed and the clean linen can be pulled out from underneath the patient 26 and spread uniformly over the mattress.

In their simplest form, the arms 17 of the present invention used for lifting and repositioning remain fixed and extend outward of the support column 13 thereby allowing them to be positioned over a patient 26 in a bed 25. This will allow the utility of the present invention to be realized since it can easily be moved around to any position over a bed 25. This is especially so if there is a base that incorporates locking wheels 7 with telescoping or otherwise adjustable legs.

Figure 9:
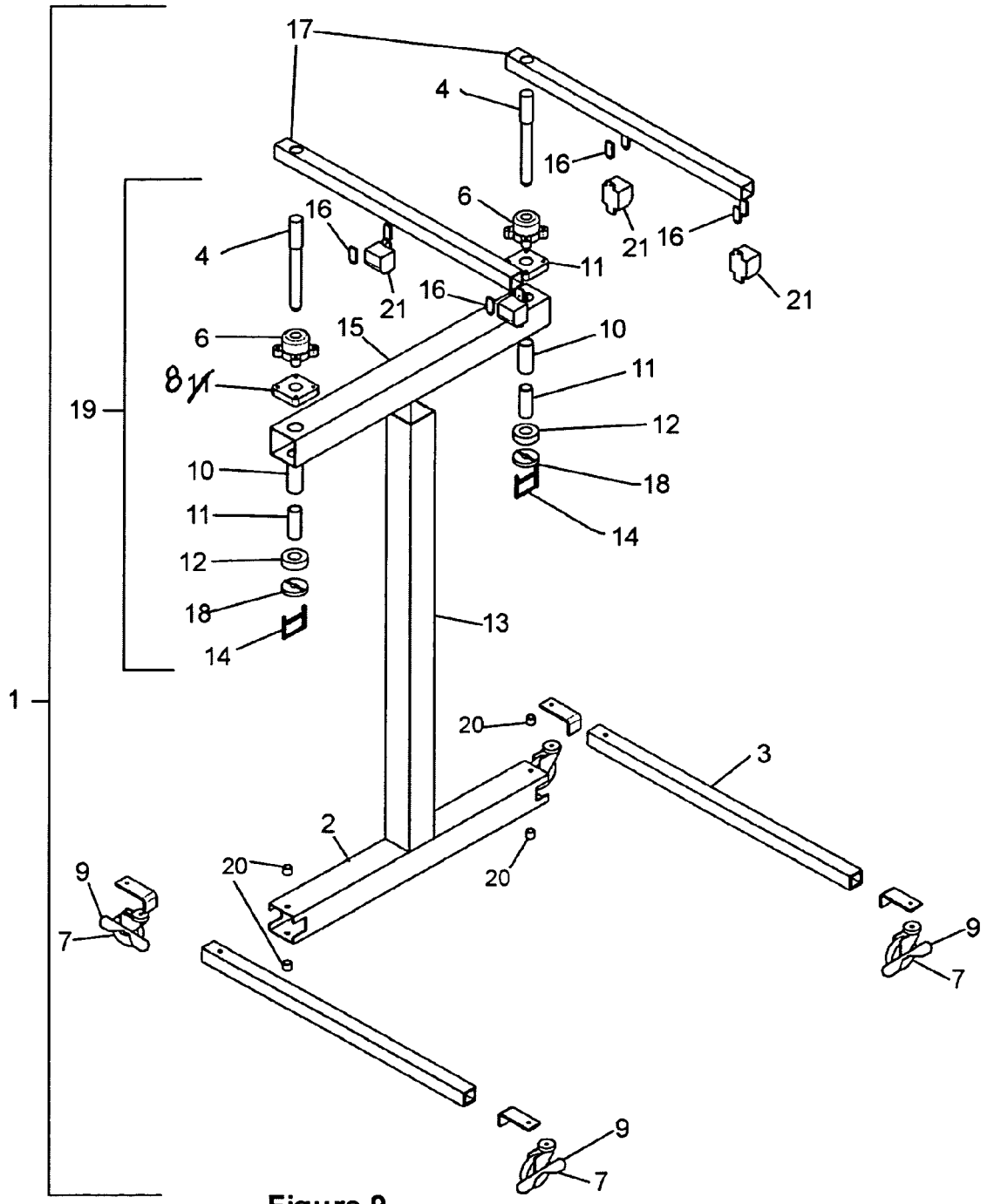
FIG. 9 is an exploded view of a patient positioning apparatus with retractable positioning arms.
Figure 10:
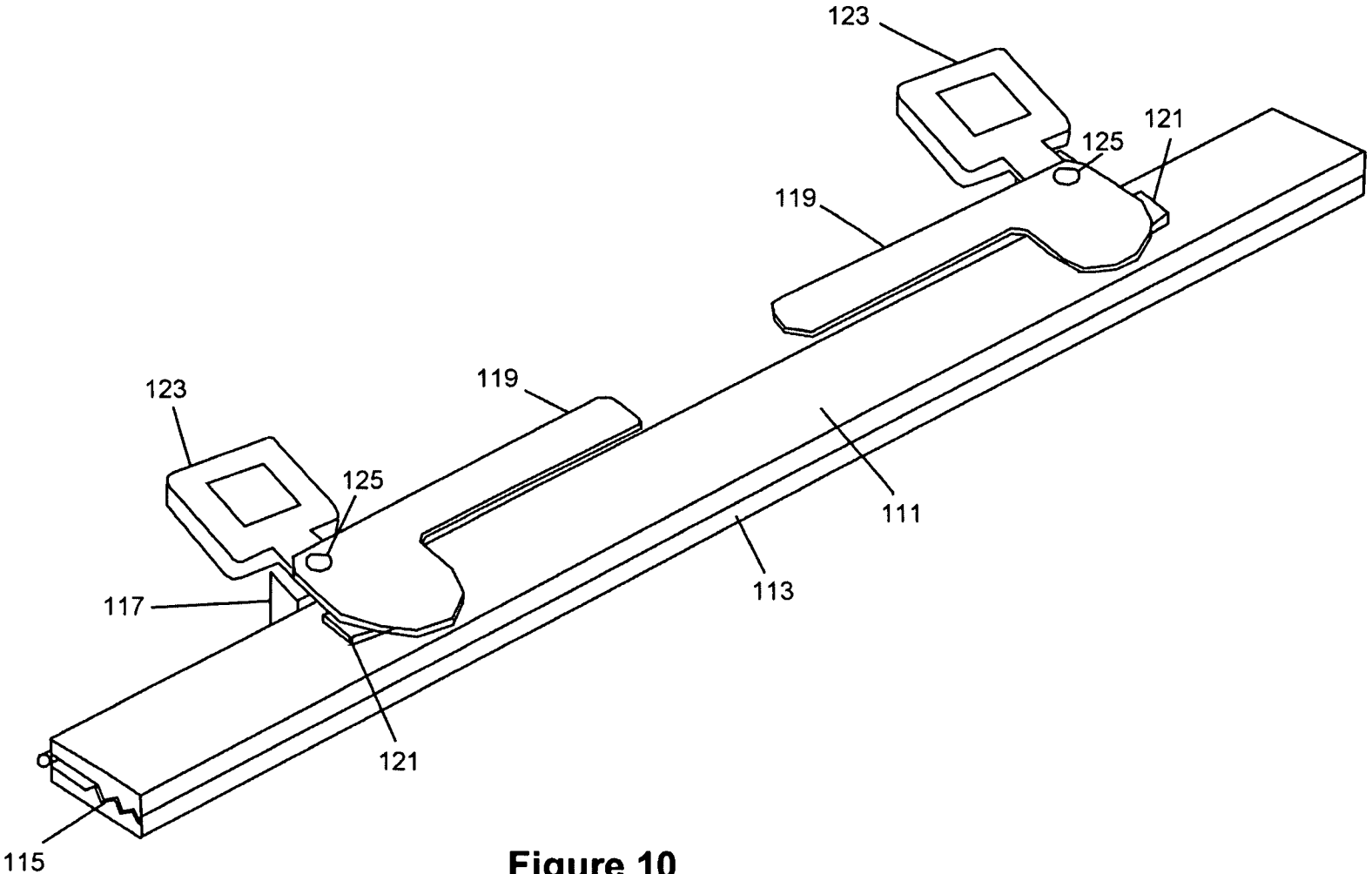
FIG. 10 is an elevated front perspective view of a fabric gripper incorporating interlocking serrated teeth for gripping fabric.
Figure 10A:
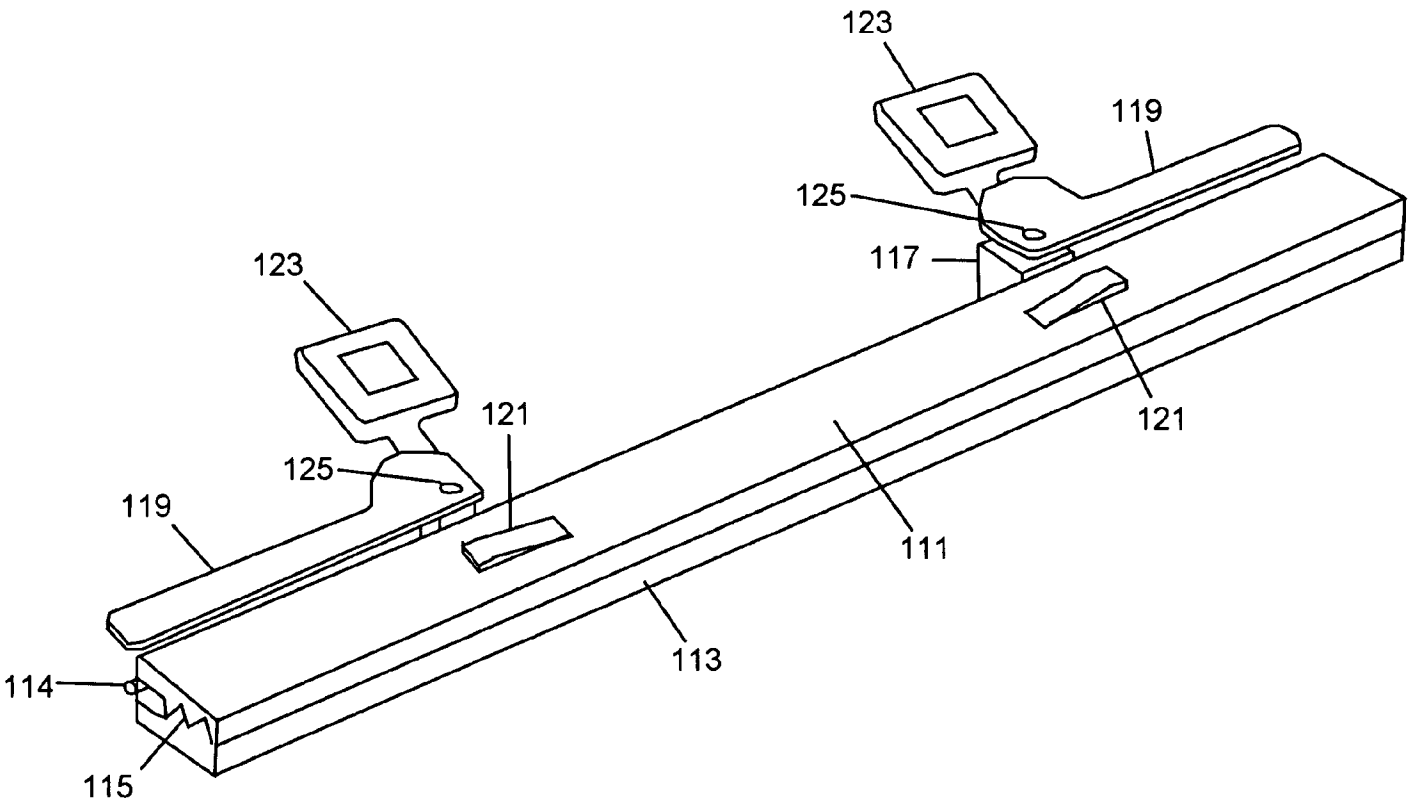
FIG. 10*a* is an elevated front perspective view of a fabric gripper closed with wedges visible.
Figure 11:
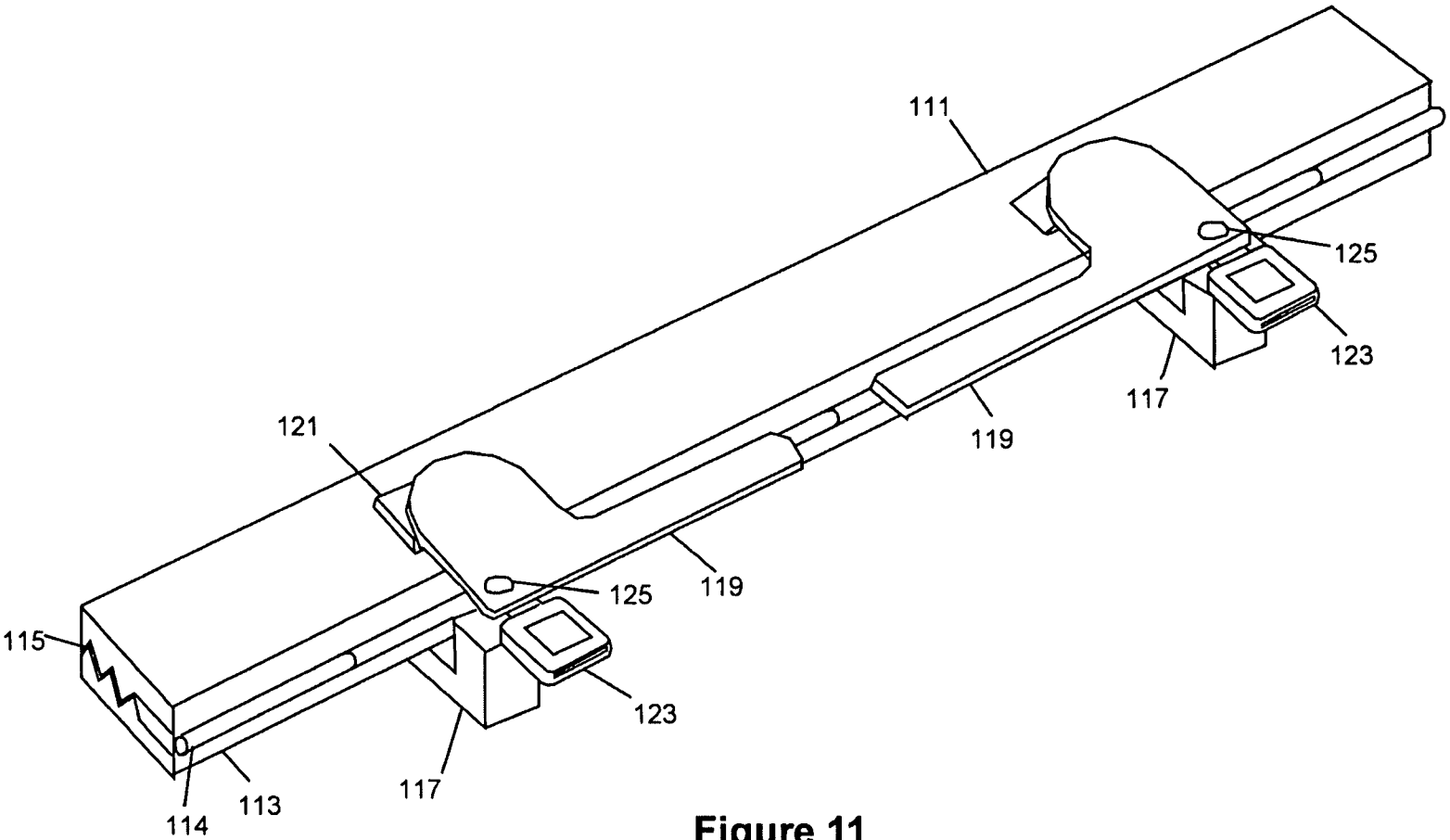
FIG. 11 is an elevated rear perspective view of a fabric gripper incorporating interlocking serrated teeth for gripping fabric.
Figure 12:
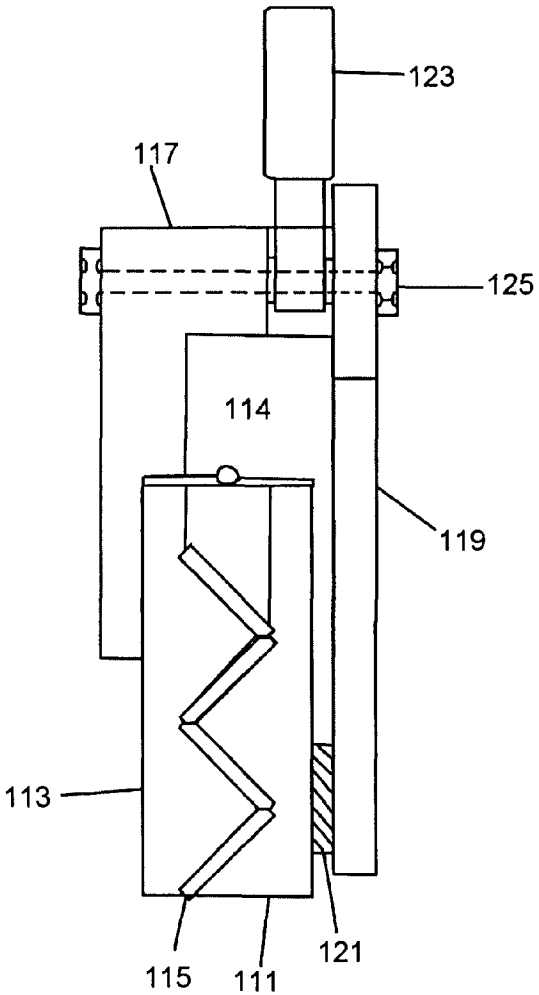
FIG. 12 is a side view of a fabric gripper incorporating interlocking serrated teeth for gripping fabric.

In a preferred embodiment, shown in FIG. 1 and in an exploded view in FIG. 9, arms 17 are joined to a horizontal support 15 through locking arm pivots 19 that allow the arms 17 to extend outward when in use and to retract inward toward the support column 13 when not in use. The pivot pin arrangement incorporates pivot shafts 4 placed inside a flange bearing 6 and bearing extension plate 8 allowing the shaft 4 to rotate. The shaft 4, bearing 6, and extension plate 8 are then situated over an aperture on both the top and bottom of the arm 17. On the bottom of the arm 17 is a hole stiffener 10 and sleeve 11 into which the shaft 4 can be inserted and over on which are inserted a top 12 and bottom 22 washer and spring loaded handle 14 capable of engaging and disengaging the washers 12 22 thereby allowing the arms 17 to rotate. When the handle is released, the washers 12 22 will engage to lock the arm 17 in place. Alternatively, a simple pivot mechanism would also work. The advantage of the washer assembly is that it allows both arms to retract and extend at an equal height.

Although the above-described embodiment is the preferred method for extending and retracting arms, there are other exemplary assemblies known in the art that can also provide movement acceptable for purposes of achieving the objects of the present invention.

Once an arm 17 is positioned over a patient 26, it is secured to a support sheet 33 through the preferred use of a buckle assembly and capable of supporting a patient 26. Because patients can oftentimes be overweight, retractable straps with buckles using heavy duty nylon or canvas or other similar materials can be used to account for extra weight. Acceptable retractable devices can be found in standard off-the-shelf seat belt units incorporating heavy duty nylon webbing capable of supporting a person suspended by the arms 17. McMaster-Carr retractable assemblies have been found to meet acceptable standards of load to lift ratios. Seat belts of this type with release buttons on the buckle inserts similar to those used in automobiles and which can withstand inertial unlatching are common. (See, for example, U.S. Pat. No. 6,725,509 to Lee and its related references) Further, the receiving mechanism for the buckles can be attached to the support sheet, a gripper or other mechanism secured to the support sheet or in other embodiments those skilled in the art will immediately appreciate.

Figure 13:
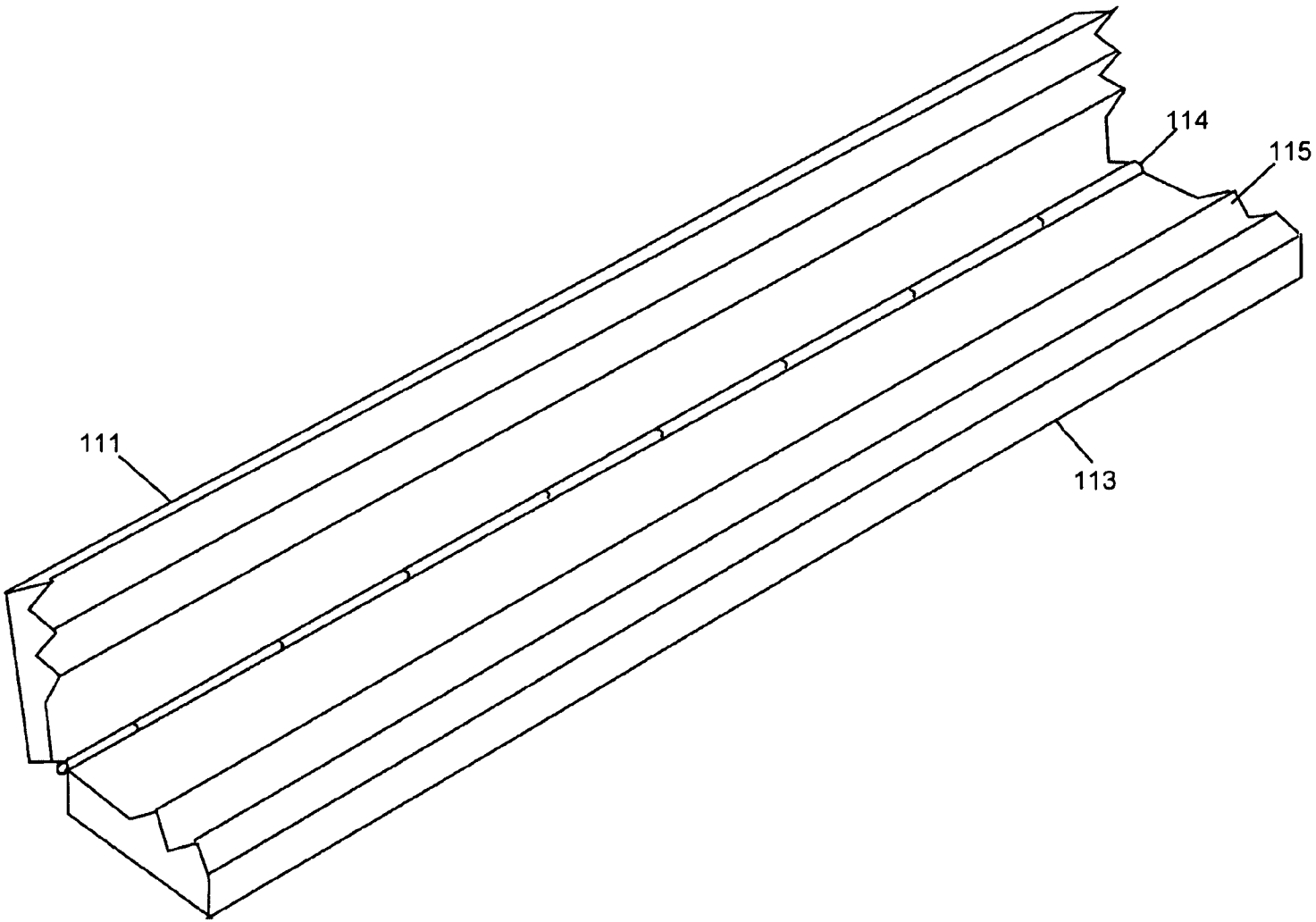
FIG. 13 is an elevated front perspective view of a fabric gripper incorporating interlocking serrated teeth for gripping fabric in an open position.
Figure 14:
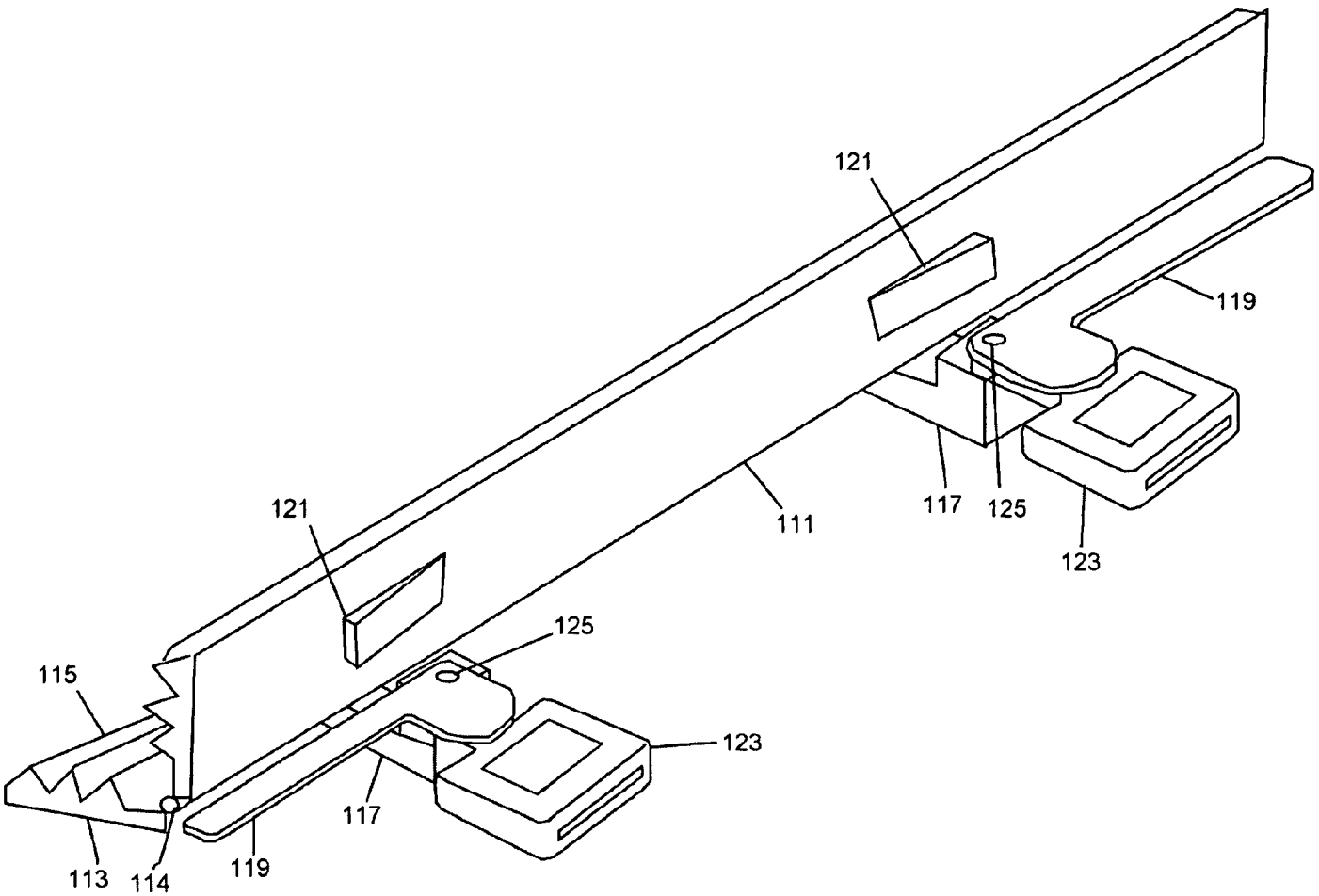
FIG. 14 is an elevated rear perspective view of a fabric gripper incorporating interlocking serrated teeth for gripping fabric in an open position.
Figure 15:
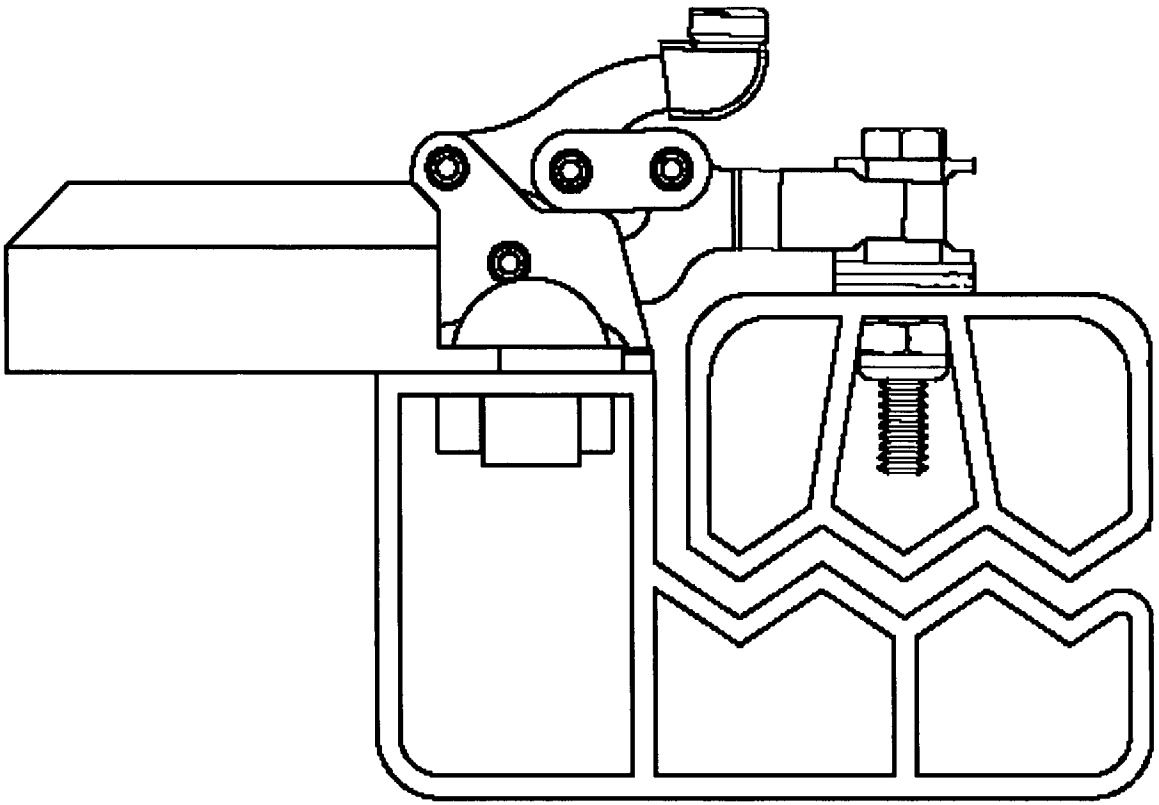
FIG. 15 is a side view of a fabric gripper utilizing a toggle clamp.

A preferred embodiment for securing to a support sheet is to use a detachable fabric gripper as is shown in FIGS. 10-14 that may be attached to linens found in hospitals and other patient care facilities. A fabric gripper is comprised of an upper bar 111 and lower bar 113 which are hinged 114 along an edge joining the upper 111 and lower 113 bars. On the inside of each bar 111 113 that contacts the other are interlocking serrated teeth 115 used to securely grab fabric. It is preferred that the teeth 115 are lined with a non-slip material, such as rubber or other similar coating to prevent linen slippage. In another exemplary embodiment, non-serrated bars also have been shown to be effective and will generally support patients in excess of 200 lbs. FIGS. 13 and 14 shows a fabric gripper in an open and in a closed position.

A bottom bar 113 has a clamp support 117, which attaches to the lower bar 113, and then extends towards the top bar 111 where it provides support for a receiving buckle 9 and a clamp handle 119. The handle 119 pivots on a pin 125 that pivotally mounts it to the clamp support 117 and the receiving buckle 9. When closed, the handle 119 extends over the top bar, and engages a wedge 121 thereby sealing the bars 111 113 together. Wedges 121 on the bars (beneath the handle flanges) ensure a tight grip when the handle is closed. A slick material on the wedge 121 (e.g., Teflon) can be used to facilitate the closing of the handle 119. Preferably, the handle 119 is long enough to provide sufficient leverage to wedge the bars 111 113 closed.

On the pivot pins 125 which support the handles 119 support clamps 117, are mounted receiving buckles 9, similar to seat belt latches as described above, to receive buckle inserts 24 at the end of the retractable straps 23 on a patient mobility apparatus 1. In use, a caregiver would fold a draw sheet of a hospital bed to a desired position. A fabric gripper would be placed open on a bed next to the fold of the draw sheet. The fold of fabric is then tucked into the gripper, which is then closed. The handles 119 are then moved to the closed position against the wedge 121 to firmly grip the fabric in place.

A handle 119 and wedge 121 arrangements is a simple, cost-effective gripping assembly although, other arrangements can be used. (e.g., spring biased mechanisms, manually locking mechanisms, toggle clamps, and etc. can also be used). For example, using the same bar arrangement as described above, toggle clamps can be used to allow for hinging, opening, closing, and locking the bars securely shut after a fabric sheet is placed between the two bars.

As an alternative embodiment, straps of any durable material can be fixed, permanent or removable, to either the retractable belts 21 or the receiving buckles 29 that incorporate a traditional belt and buckle arrangement. Using this arrangement, straps 23 can be cinched to a desired length and tension. When not in use they can then be placed to the side of the bed. Furthermore, attachments to the patient support sheet need not be flexible straps but may also be of a more rigid construction.

Figure 8:
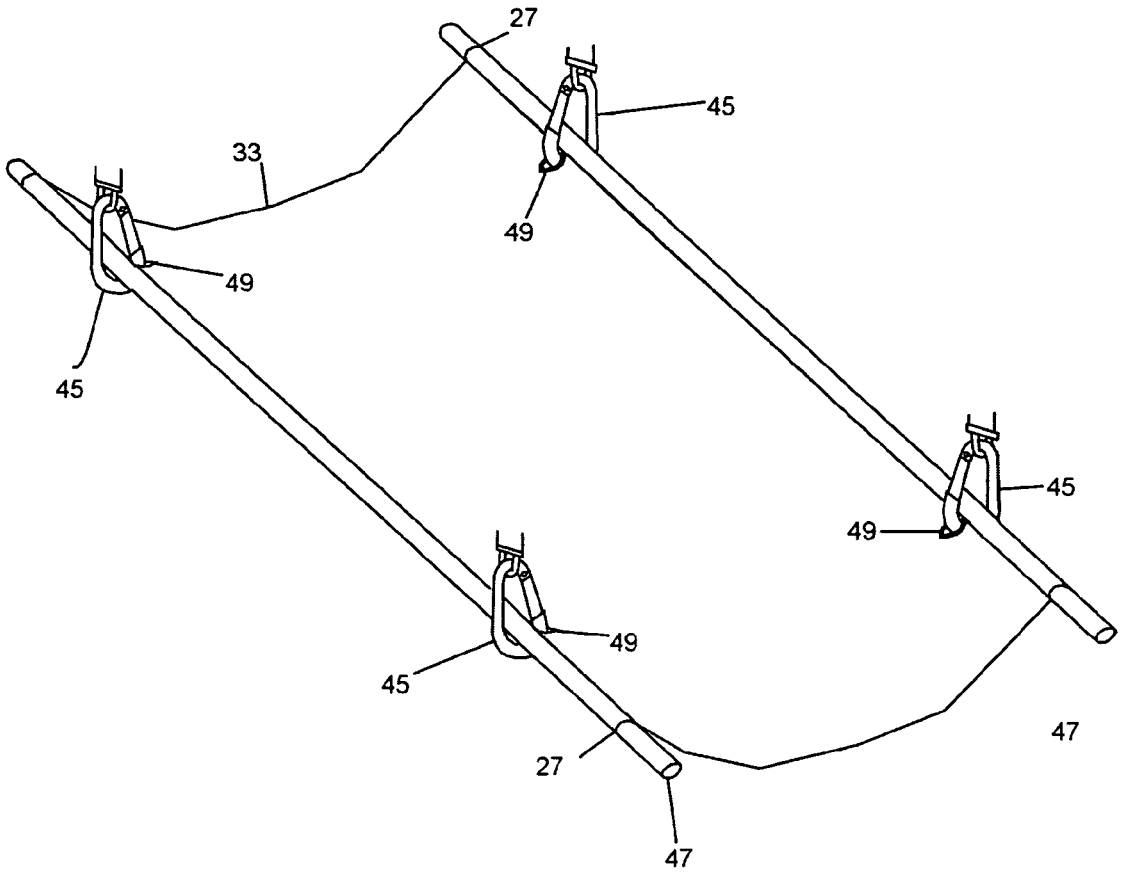
FIG. 8 shows a hook and rod arrangement fastened to a support sheet.
Figure 8A:
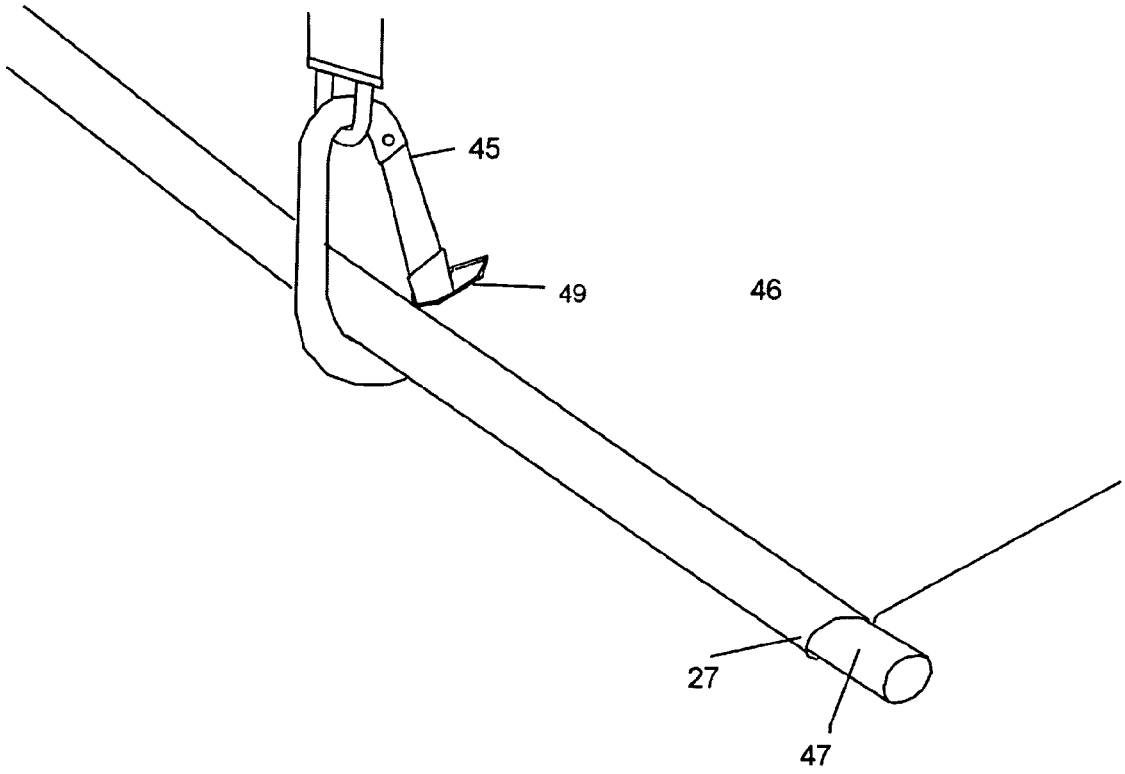
FIG. 8*a* shows a detailed view of a hook and rod arrangement fastened to a support sheet.

Support sheets 33 are preferred for the present invention to provide a stable, lifting, flexible platform on which to lift patients. Exemplary support sheets 33 proven to be acceptable for supporting patients of varying weights can be made of known vinyl, nylon, canvas or other comparable materials. Further, harnesses, or other known suspension supports have also been shown to be effective when used in accordance with the designs of the present invention. In addition, normal weight hospital sheets have been shown to work without problems. Support sheets 33 can also incorporate buckles fastened to them using known means such as sewing heavy duty buckle ends to reinforced material and stitching onto the fabric 46. Other means for fastening buckles and other attachments to the fabric 46 will be immediately identifiable to those skilled in the art. FIGS. 8 and **8*a* shows a support sheet commonly used in hospitals having pockets 27 along the sides capable of receiving a sturdy rod 47, as well as holes 49 that can be reinforced for inserting hooks such as carabiner hooks 45 secured to the end of the straps 23**. Other hook arrangements will also be sufficient such as "c", "j", or other known hooks.

Figure 6:
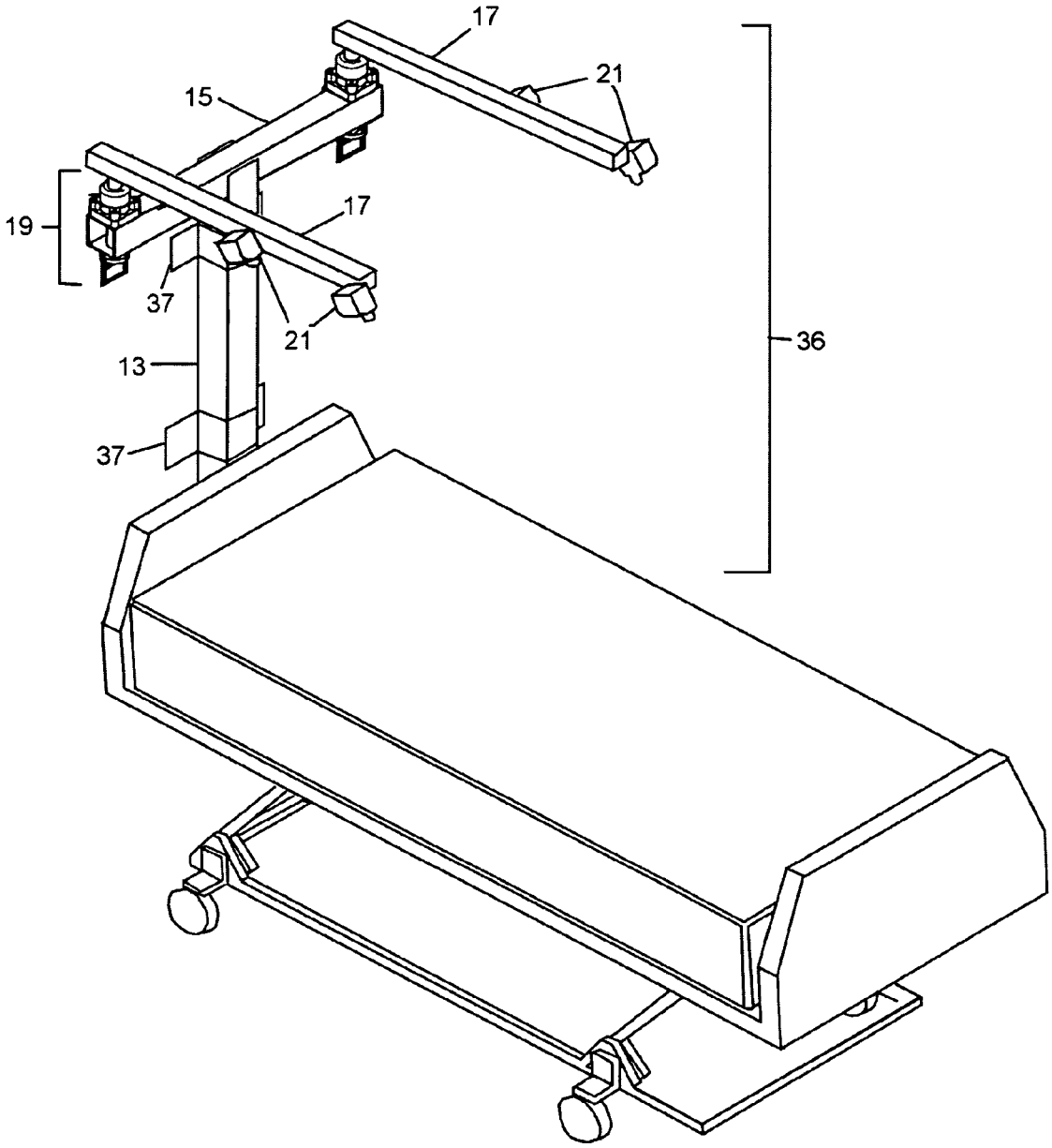
FIG. 6 is an elevated perspective view of a baseless patient positioning apparatus secured to a wall and positioned over a hospital bed.
Figure 6A:
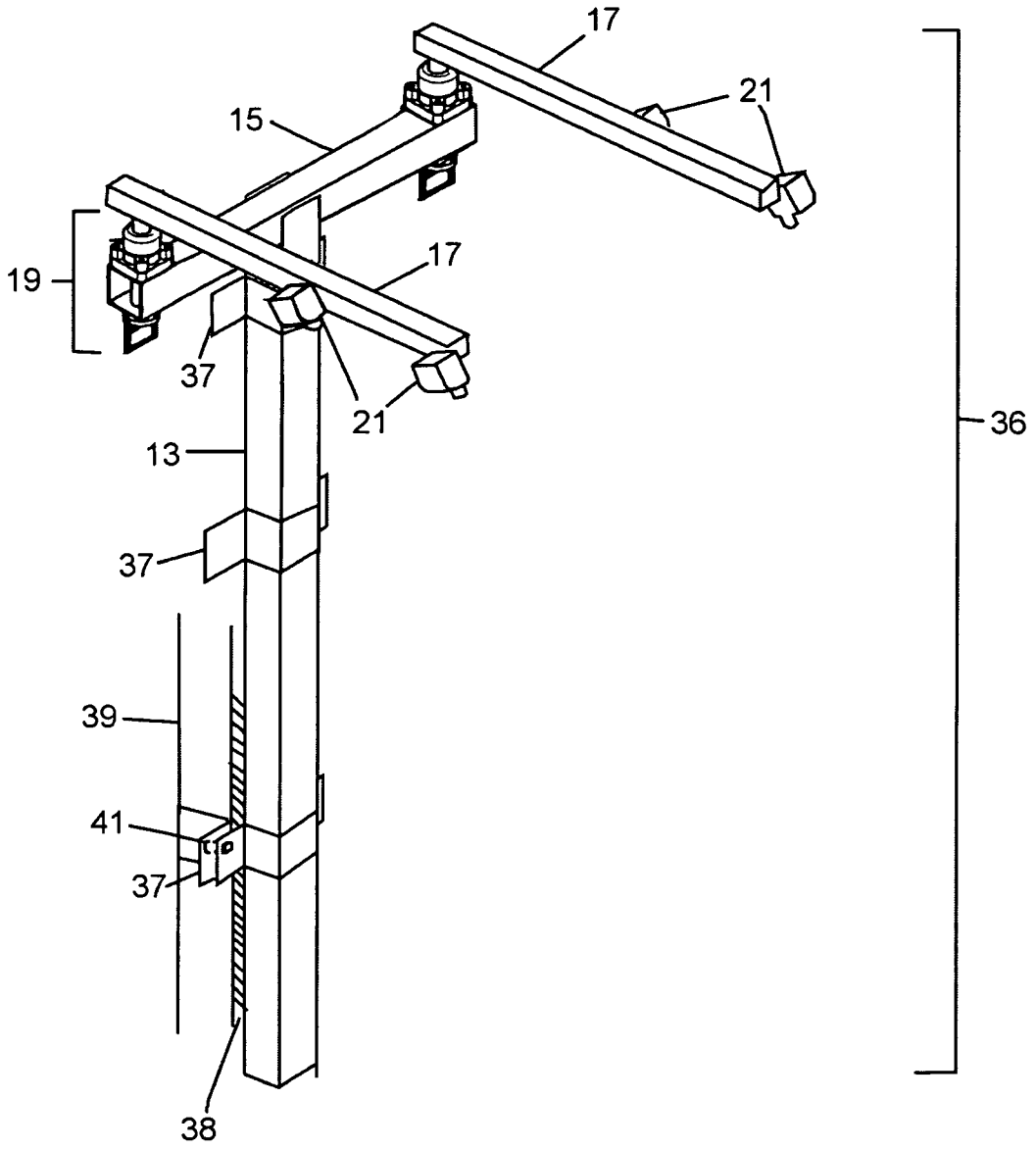
FIG. 6*a* is an elevated perspective view of a baseless patient positioning apparatus secured to a wall.
Figure 7:
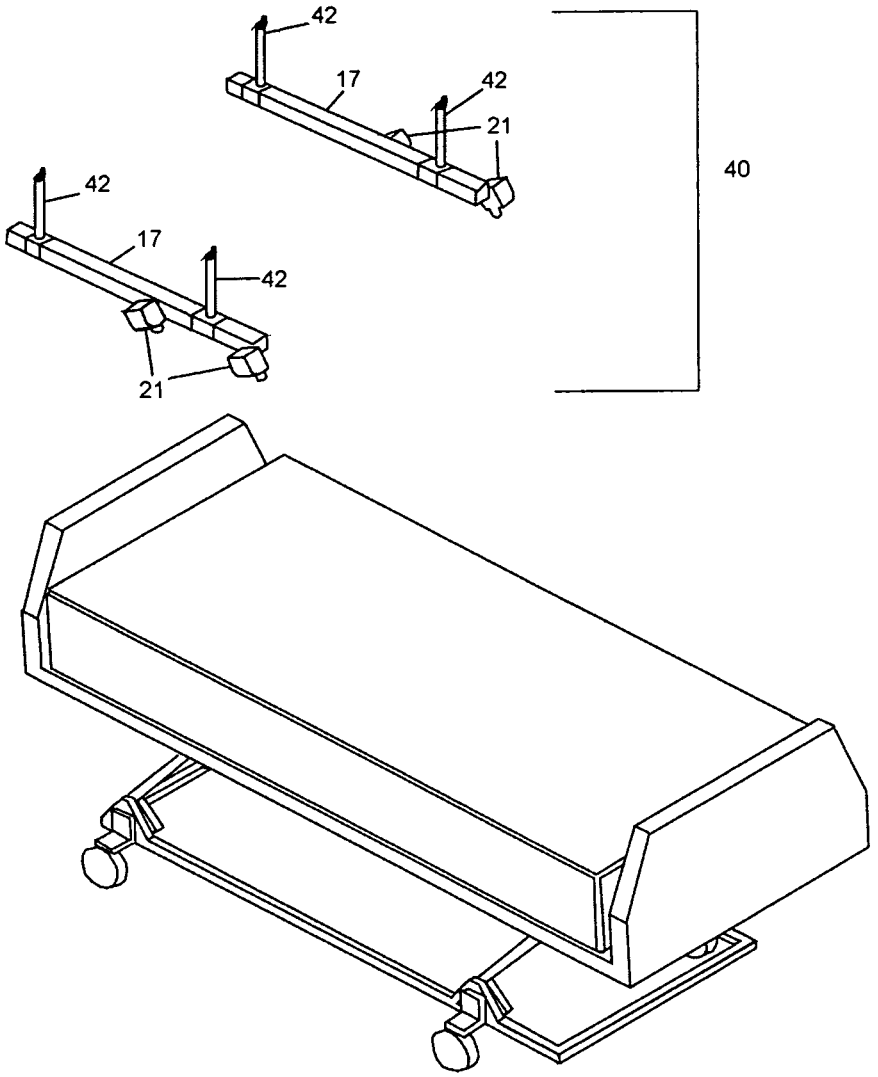
FIG. 7 is an elevated perspective view of a ceiling mounted embodiment of a patient positioning apparatus.

There are various ways in which the present invention can be mounted that will not sacrifice its utility or overall design. For example, FIGS. 6 and **6*a* illustrate a wall mounted device 36 that is secured to a wall through the use of one or more wall brackets 37. Typically, the brackets 37 are made from steel or other heavy duty metal secured to a wall 38. Brackets 37 are secured through heavy duty bolts 41 to studs 39 in a wall 38. Additionally, FIG. 7 illustrates an embodiment of the present invention 40 capable of being mounted to a ceiling through the use of one or more ceiling mounts 42. Standard mounting brackets in the art that can support the weight of a patient have proven to be effective. For example, brackets as in the wall mounted embodiment can be mounted to studs in the ceiling and incorporate known fastening means for securing the ceiling mounts 42**. In this way, the overall shape of the present invention can be altered to accommodate various designs. For example, in a slight modification to the embodiments shown in the Figures, the support column of the body can be jogged to account for bed widths and other spacing issues.

CONCLUSION, RAMIFICATIONS, AND SCOPE

While the above description contains various preferred, exemplary, and other specific embodiments, these should not be construed as limitations on the scope of the invention, but as exemplifications of the presently preferred embodiments thereof. Many other ramifications and variations are possible within the teaching of the invention.

Thus the scope of the invention should be determined by the appended claims and their legal equivalents, and not solely by the examples given.

The invention claimed is:

1. A patient positioning apparatus, comprising:

a base;

a body comprising a vertical member coupled to the base;

a cross-member coupled to the body;

at least two positioning arms each pivotably coupled to the cross-member, the positioning arms being configured to be selectively placed in a retracted configuration or in an extended configuration positioned over a bed having a mattress and a head, a foot, and two sides, such that both of the two sides of the mattress are unobstructed by any portion of the body;

a fabric gripper configured to releasably attach to a support sheet; and at least one suspension member configured to secure the fabric gripper to the positioning arm.

2. The patient positioning apparatus of claim 1, wherein the positioning arms are each pivotably coupled to the cross-member with a pivot assembly configured to hold the at least one positioning arm in each of the retracted and extended configurations.

3. The patient positioning apparatus of claim 1, wherein the at least one suspension member is configured to fix in position relative to the at least one positioning arm through a buckle device configured to extend, retract, and catch the at least one suspension member at a fixed extension as desired.

4. The patient positioning apparatus of claim 3, wherein the buckle device is further configured such that the at least one suspension member is configured to be releasably coupled to the fabric gripper.

5. The patient positioning apparatus of claim 2, wherein each pivot assembly provides for moving the positioning arms into the retracted position from the extended position, and locking the positioning arms in each of the extended and retracted positions.

6. The patient positioning apparatus of claim 1, wherein the body includes locking swivel devices.

7. The patient positioning apparatus of claim 1, wherein the support sheet is a bed sheet.

8. The patient positioning apparatus of claim 1, wherein the at least one positioning arm includes one or more locking, retractable devices.

9. The patient positioning apparatus of claim 1 wherein said the base includes one or more locking wheels.

10. The patient positioning apparatus of claim 1, wherein the base includes one or more foldable, locking legs.

11. The patient positioning apparatus of claim 1 wherein, the at least one suspension member further includes one or more buckle and strap assemblies configured to releasably connect the fabric gripper to the at least one positioning arm.

* * * * *